US006735807B2

(12) United States Patent
Brent

(10) Patent No.: US 6,735,807 B2
(45) Date of Patent: May 18, 2004

(54) BOOT CLEANING APPARATUS

(76) Inventor: Howard Brent, P.O. Box 896, Greenville, MS (US) 38702

( * ) Notice: Subject to any disclaimer, the term of this patent is extended or adjusted under 35 U.S.C. 154(b) by 12 days.

(21) Appl. No.: 10/147,356

(22) Filed: May 17, 2002

(65) Prior Publication Data

US 2002/0170132 A1 Nov. 21, 2002

Related U.S. Application Data

(60) Provisional application No. 60/291,969, filed on May 21, 2001.

(51) Int. Cl.[7] ..... A47L 23/22; A46B 11/00
(52) U.S. Cl. ..... 15/104.92; 15/161
(58) Field of Search ..... 15/104.92, 112, 15/161

(56) References Cited

U.S. PATENT DOCUMENTS

| | | | | | |
|---|---|---|---|---|---|
| 173,707 | A | * | 2/1876 | Worley | 15/112 |
| 726,201 | A | | 4/1903 | Strombeck | 15/161 |
| 747,031 | A | | 12/1903 | Bartoszek | 15/161 |
| 1,114,944 | A | | 10/1914 | Varga | 15/161 |
| 1,135,453 | A | | 4/1915 | Hitt | 15/161 |
| 1,569,939 | A | | 1/1926 | Sperling | 15/161 |
| 2,210,365 | A | | 8/1940 | Gilpin | 15/161 |
| 2,744,276 | A | * | 5/1956 | Chambless | 15/104.92 |
| 3,074,093 | A | | 1/1963 | McDonald | 15/161 |
| 3,641,609 | A | | 2/1972 | Hansen | 15/112 |
| 3,737,942 | A | | 6/1973 | Casey | 15/339 |
| 4,380,839 | A | * | 4/1983 | Caradonna | 15/104.92 |
| 4,872,235 | A | * | 10/1989 | Nielsen | 15/104.92 |
| 5,321,867 | A | | 6/1994 | Probst | 15/160 |
| 5,404,610 | A | * | 4/1995 | Coyer, Sr. et al. | 15/104.92 |
| 5,652,993 | A | * | 8/1997 | Kreyer | 15/104.92 |
| 5,794,301 | A | * | 8/1998 | Hietala | 15/104.92 |
| 5,950,269 | A | | 9/1999 | Openshaw et al. | 15/36 |
| 5,964,959 | A | | 10/1999 | Bleth | 134/32 |

* cited by examiner

*Primary Examiner*—Mark Spisich
(74) *Attorney, Agent, or Firm*—Shlesinger, Arkwright & Garvey LLP

(57) ABSTRACT

A boot cleaning apparatus comprising a fluid reservoir operatively associated with a frame assembly adapted to be fitted within the interior of the reservoir. The frame assembly includes at least one brush member secured to the assembly and aligned so that a boot or shoe inserted against the brush is caused to be scrubbed and dirt or waste material is removed from the surface of the boot. The sub-assembly is adapted to be removed from the reservoir.

13 Claims, 5 Drawing Sheets

BOOT CLEANING APPARATUS

CROSS REFERENCE TO RELATED APPLICATION

This application is a nonprovisional application claiming the benefit of U.S. Provisional Application Serial No. 60/291,969 filed on May 21, 2001.

FIELD OF THE INVENTION

The present invention relates to a footwear cleaning apparatus and in particular, an apparatus for washing and scrubbing boots; namely, rubber or other waterproof boots.

BACKGROUND OF THE INVENTION

Boot and foot cleaning devices comprising a housing having brushes positioned within the interior of the housing are known. These devices enable a person to scrub dirt from their feet or from their boots from a standing position. For example, each of U.S. Pat. Nos. 747,031 to Bartoszek and 5,321,867 to Probst disclose housings having brushes variously mounted to the interior walls of the housing. However, these prior art devices are not adapted to simultaneously wash the boots unless the device is placed within a shower stall or otherwise near a water supply. Although self-contained water supplies are known from U.S. Pat. Nos. 5,950,269 to Openshaw et al. and 3,641,609 to Hansen, these devices do not clean and wash the entire boot but only the underside or sole of the boot.

DETAILED DESCRIPTION OF THE PREFERRED EMBODIMENTS

Figure 1:
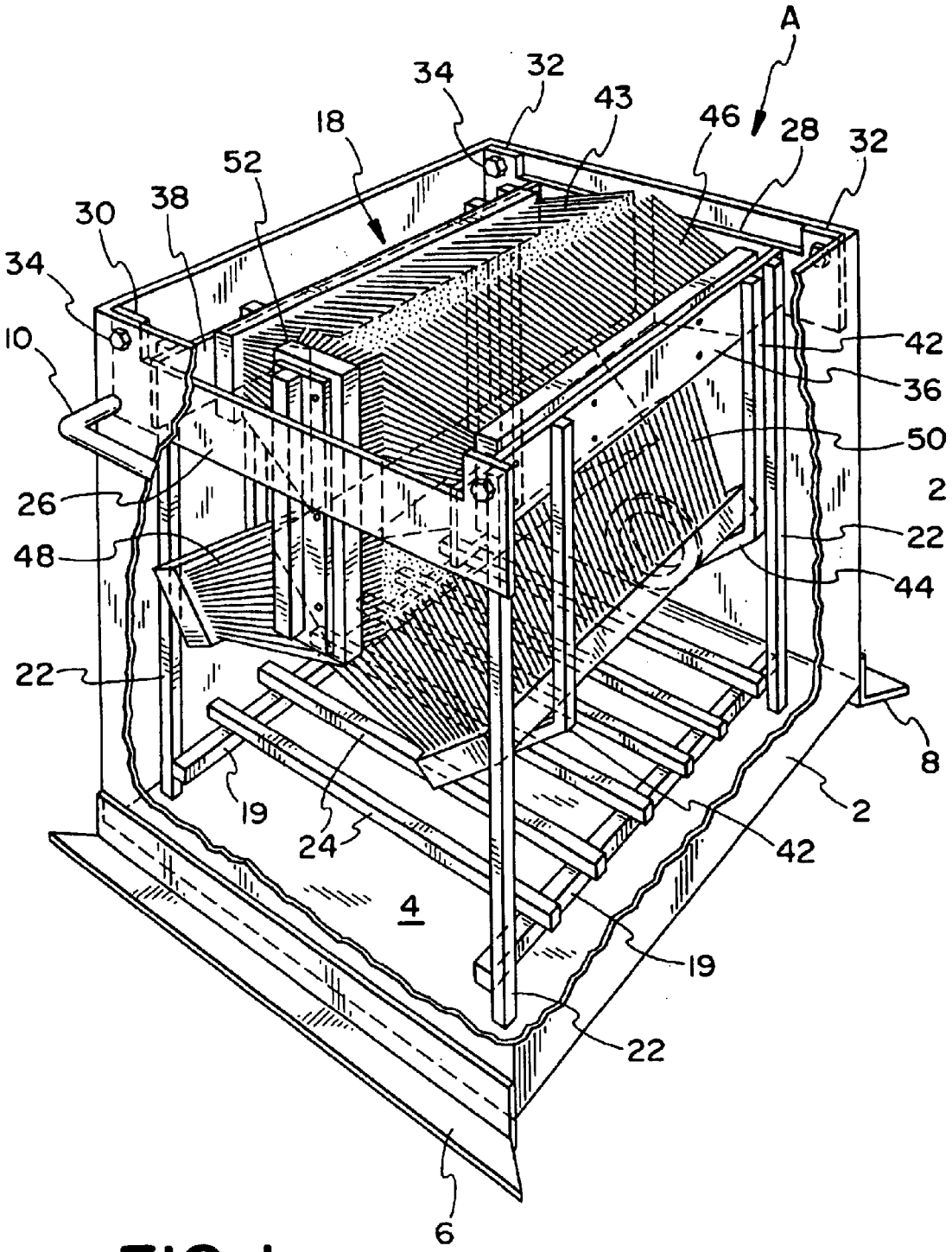
FIG. 1 is a perspective view of an embodiment according to the present invention with portions of the receptacle shown broken away.

FIGS. 1 through 4 illustrate an embodiment to the present invention. The boot cleaning apparatus A includes a housing or water reservoir 2 having a generally rectangular shape shown to comprise four interconnected side walls and a bottom 4. As is apparent, the shape and size of the reservoir may be varied from that shown in the drawings without departing from the scope of the present invention. An optional pair of flanges 6 and 8 may be provided as well as an optional pair of handles 10 and 12. A drain plug 14, operably associated with a drain 16, extends through one of the side walls and into the water reservoir 2 at or near the bottom 4.

As noted earlier, the dimension of water reservoir 2 may vary. In a preferred embodiment, the reservoir may be about fifteen inches wide, twenty-three inches long and have a height of approximately sixteen inches. The device may be constructed from metal, plastic or any other material adapted to readily confine water to the interior of the reservoir.

Apparatus A further includes a frame assembly or brush insert 18 adapted to be received within the reservoir 2. Brush insert 18 is shown in FIGS. 1 through 4 to comprise a frame member 20 consisting of four separate, vertically extending corner members 22, two of which are interconnected at respective bottom ends by a separate one of a pair of longitudinal bars 19. Longitudinal bars 19 are shown to be interconnected by a series of parallel support bars 24. The parallel support bars 24 function to prevent the users foot from coming into contact with the bottom of reservoir 2 as will be further explained below.

Figure 2:
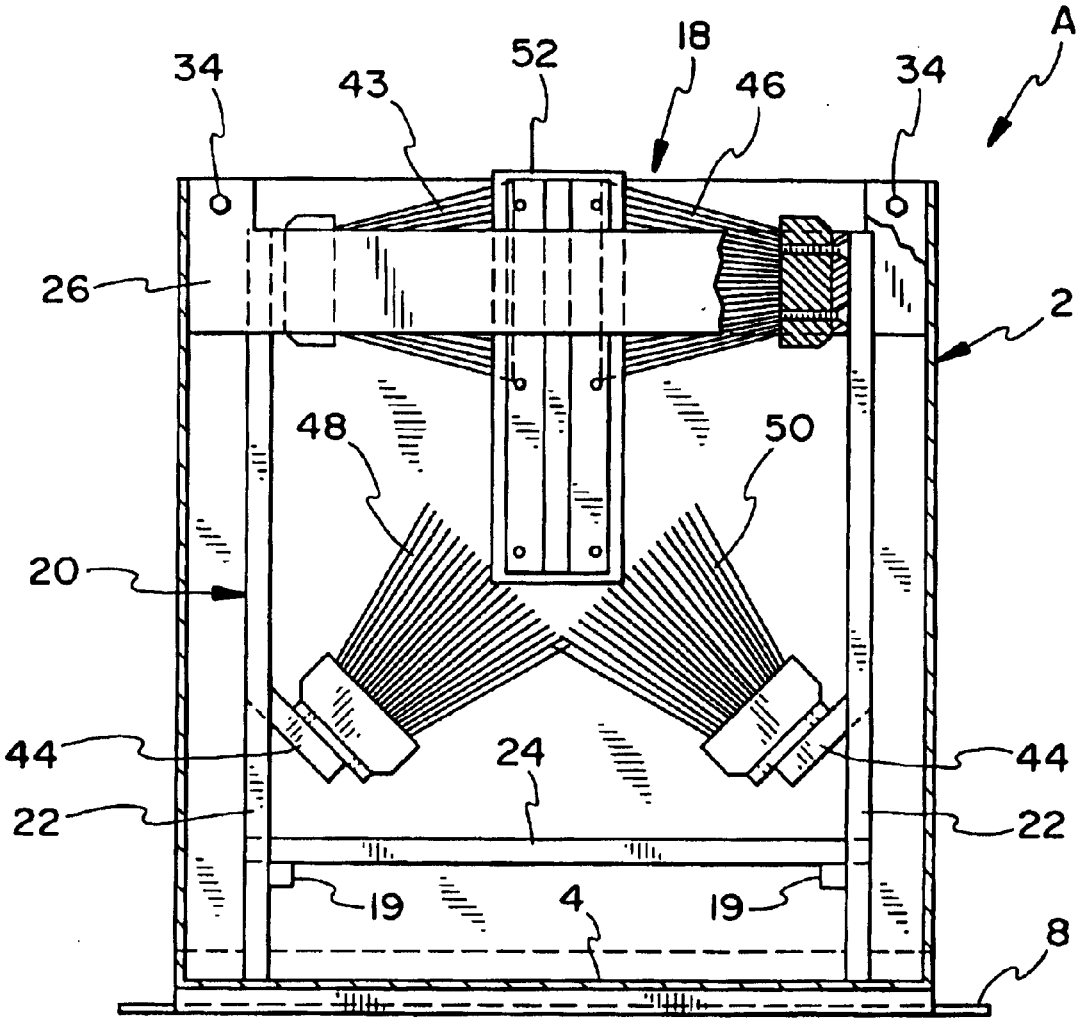
FIG. 2 is a cross-sectional view taken along lines 2—2 of FIG. 3.
Figure 3:
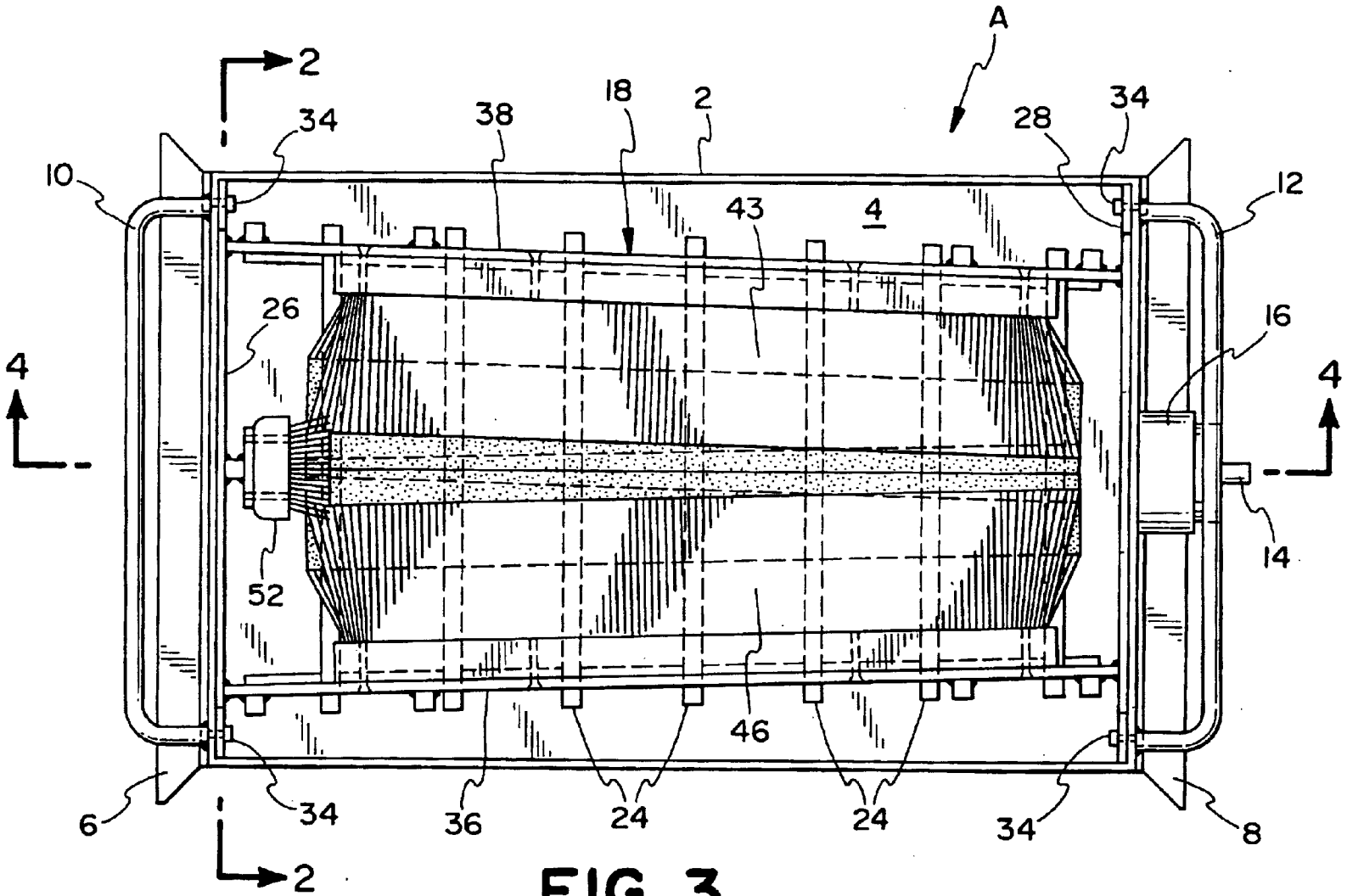
FIG. 3 is a top plan view of the device shown in FIG. 1.

At an opposite upper end of the brush insert 18 are top brackets 26 and 28. Top brackets 26 and 28 are interconnected via crossbars 36 and 38. As best shown in FIG. 3, crossbars 36 and 38 are secured to top brackets 26 and 28 in a manner so that they taper along a longitudinal axis thereof. The tapering functions to position and angle the cleaning brushes as will be further explained below. In the embodiments shown in FIGS. 1 through 4, each of the top brackets 26 and 28 includes a respective one of flange portions 30 and 32 extending from the opposite ends of the brackets. The flanges are operatively associated with mounting bolts 34 extending through respective side walls of the reservoir 2 to rigidly secure the brush insert 18 to the interior of water reservoir 2.

Extending downwardly from each of crossbars 36 and 38 are respective pairs of brush support bars 42 which terminate at respective angled portions 44. A pair of brushes 43 and 46 are shown secured to separate respective crossbars 36 and 38 in an opposed manner so that the ends of the bristles face one another as best shown in FIGS. 1 and 2. A variety of brushes may be used according to the present invention, the brushes having bristles of varying stiffness or rigidity depending upon the application. For example, if the device will be used to remove heavy mud from boots, relatively stiff bristle may be used whereas if the device will be used to lightly scrub the surface of the boot, a less stiff bristle may be used. As can be seen in the drawings, the brushes are positioned closer together at one end of the brush insert 18 and further apart at a second opposite end thereof.

A second pair of brushes 48 and 50 are and secured to angled portions 44 of support bars 42 in a face to face relation. Brushes 48 and 50 may be of similar construction to brushes 43 and 46. Brushes 48 and 50 are shown to be positioned an angle of about 90° relative to each other; however, it is within the scope of the present invention to modify this angle or provide no angle so that the brushes are aligned in a face to face relation as in the case with brushes 43 and 46. A brush 52 is shown secured to top bracket 26 and in a manner transverse to the longitudinal axis of the apparatus. Brush 52 is provided with an overall length which extends from about the top of the brush insert 18 to about the bristles of brushes 48 and 50.

Figure 4:
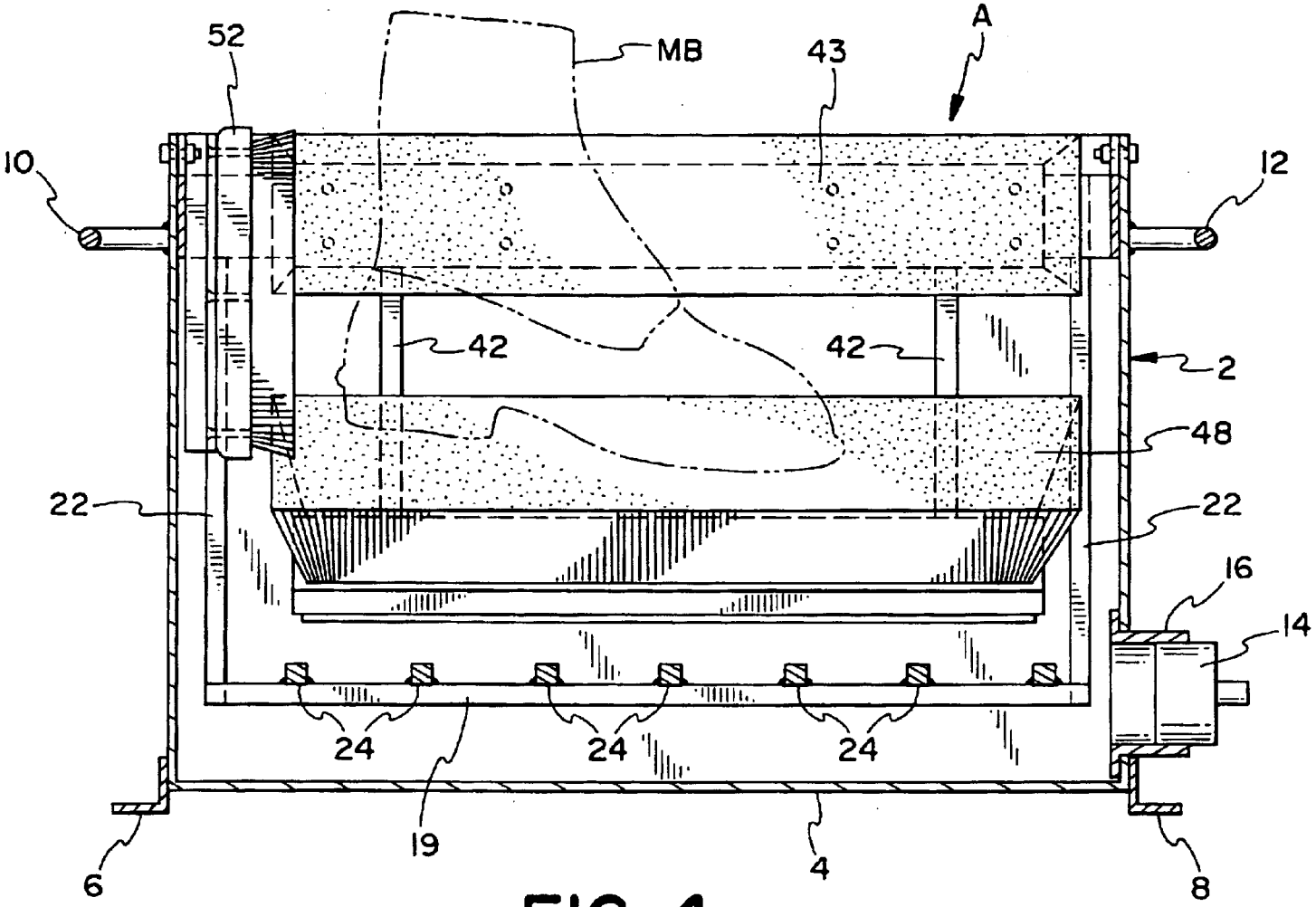
FIG. 4 is a cross-sectional view taken along lines 4—4 of FIG. 3 and showing a users boot phantom lines being inserted into the apparatus.

During use and as best shown in FIG. 4, reservoir 2 may be substantially filled with water or a disinfecting liquid (not shown). An individual (not shown) intending to clean their boot or shoe will step into the apparatus A and move their leg in an upward and downward motion so that the dirty boot MB is caused to be contacted on all sides by aligned brushes 43, 46, 48, 50 and 52 thereby removing mud, dirt or other material from the surfaces of the boot MB. The face to face alignment of brushes 43 and 46 ensure the ends of the brush bristles scrub against the bottom as well as the sides of the boot MB. The angled brushes 48 and 50 provide supplemental scrubbing against the bottom and sides of the boot MB as it passes beneath brushes 43 and 46. In addition, brush 52 will provide scrubbing of the boot MB along a vertical plane to remove dirt and wash the front or back of the boot MB. As mud and/or dirt or other waste material are continually scrubbed away and removed from the surface of the boot MB, it will dissolve into the surrounding water and settle at the bottom of the reservoir 2. To prevent further contact with this accumulating mud or dirt, parallel support bars 24 are provided to maintain the boot MB above the bottom surface of the reservoir 2. As is readily apparent, the lower frame member comprising parallel bars 24 is optional. Following use, the brush insert 18 may be disconnected from the reservoir and lifted out of the reservoir 2 to allow the interior of the reservoir 2 and the various brushes to be separately cleaned. Drain plug 14 is opened and the interior of the reservoir is easily hosed down or otherwise washed so that the accumulated debris is quickly caused to exit drain 16. The above provides a safe and effective method for ensuring any contaminated water or other fluid is properly contained and disposed of. Further, the provision of a removable frame assembly or brush insert enables the brushes to be cleaned separate from the reservoir and thus cleaned in an effective manner.

Figure 5:
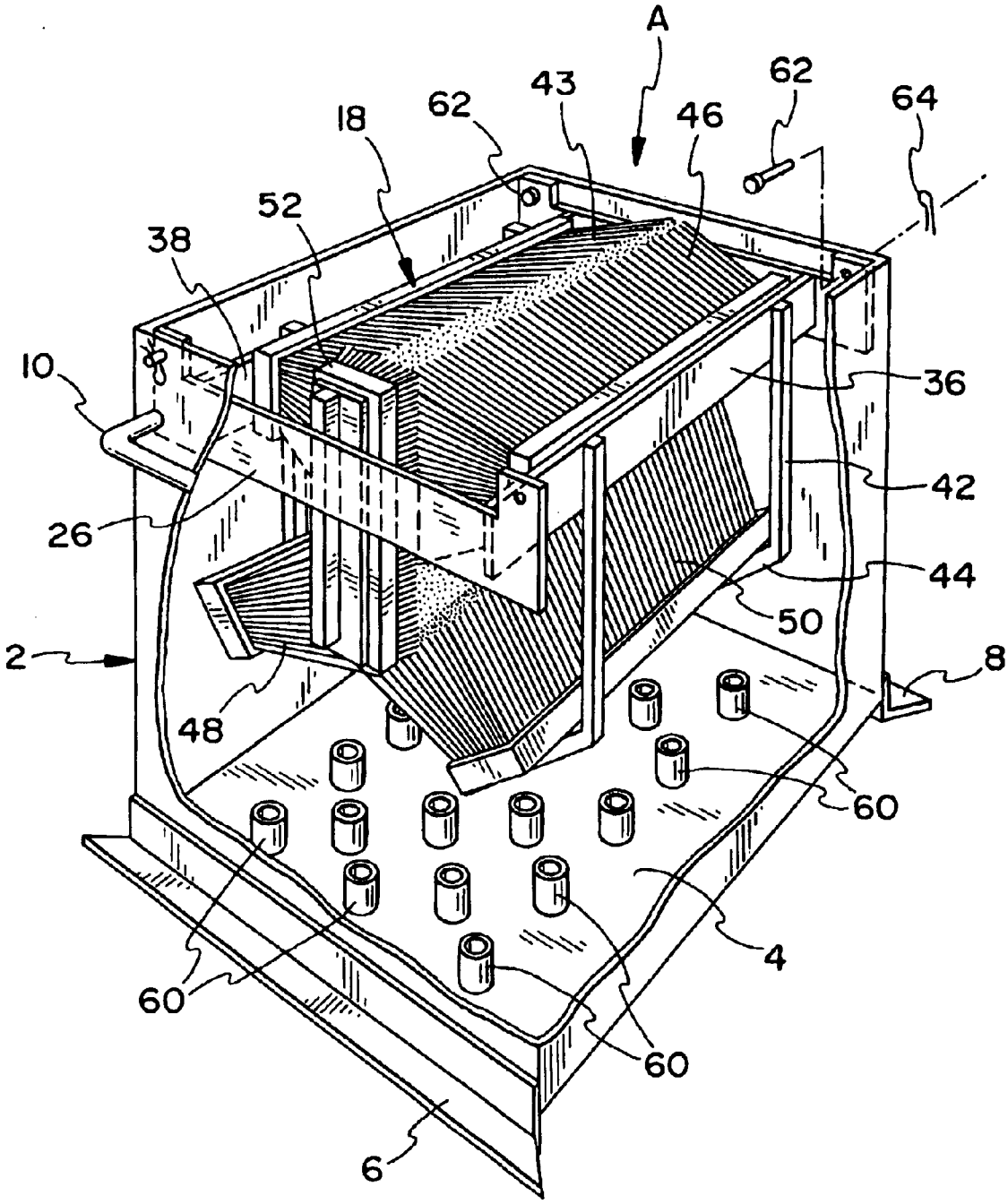
FIG. 5 is a perspective view of another embodiment of the boot cleaning apparatus according to the present invention with portions of the receptacle shown broken away.

FIG. 5 illustrates another embodiment of the present invention. In this embodiment, those portions of the frame assembly or brush insert 18 which cooperate to provide a foot rest to prevent a shoe or boot from contacting the bottom 4 of the fluid reservoir 2 are removed. In addition, the bottom 4 of the reservoir 2 may be provided with a series of raised members 60 which extending upwardly from the surface of the reservoir bottom 4. Raised members 60 function to prevent the shoe or boot from contacting the bottom of the reservoir which may, as noted earlier, become accumulated with dirt or debris. In addition, a bolt 62 and cotter pin 64 assembly may be provided in place of the nut and bolt arrangement described above. This will enable the sub-frame assembly to be easily disconnected from the reservoir and without the need for supplemental tools.

While this invention has been described as having a preferred design, it is understood that it is capable of further modification, uses and/or adaptations following in general the principles of the invention and including such departures from the present disclosure as come within known or customary practice in the art to which the invention pertains, and as may be applied to the essential features set forth, and fall within the scope of the invention.

I claim:

1. A footwear cleaning apparatus comprising:

a) a receptacle for containing a fluid, said receptacle having a side wall, a bottom and an open top;

b) a frame assembly, said frame assembly configured to be received within said receptacle and adapted to be selectively secured to said receptacle side wall; and c) at least one brush member, said at least one brush member having first and second ends, said at least one brush member is fixed to said frame assembly to provide a stationary brushing surface within said receptacle and in a manner so that footwear to be cleaned may be inserted through said open top and be received within said receptacle;

d) said frame assembly including first and second frame members, said first-frame member secured to a first end of said at least one brush member and said second frame member secured to a second end of said at least one brush member, each of said first and second frame members secured to said receptacle side wall at opposite ends thereof;

e) a second brush member, said second brush member secured to said frame assembly so that said at least one brush member and said second brush member are parallel and aligned in an opposed relation thereto, each of said at least one brush member and said second brush member disposed adjacent said receptacle open top; and f) a foot stop, said foot stop comprising a grouping of individual abutment members extending upwardly from said receptacle bottom, each of said individual abutment members having about an equal height.

2. A footwear cleaning apparatus as in claim 1 and further including:

a) third and fourth frame members, each of said third and fourth frame members extending perpendicular to said first and second frame members and therebetween and interconnected to a separate one thereof.

3. A footwear cleaning apparatus as in claim 2 and further including:

a) first and second frame extension members, each of said first and second frame extension members disposed transverse to said third and fourth frame members and interconnected at one end thereof to a separate one of said third and fourth frame members; and b) third and fourth brush members, one of said third and fourth brush members is secured to an opposite end of said first and second frame extension members and the other of said third and fourth brush members is secured to an opposite end of the other of said first and second frame extension members so that the brush surfaces of said third and fourth brush members are parallel and aligned in an opposed relation thereto.

4. A footwear cleaning apparatus as in claim 3 and wherein:

a) said brush surfaces of said third and fourth brush members disposed relative to each other at an angle of about ninety degrees.

5. A footwear cleaning apparatus as in claim 3 and further including:

a) a fifth brush member, said fifth brush member is secured to one of said first and second frame members and aligned transverse thereto.

6. A footwear cleaning apparatus as in claim 5 and wherein:

a) the distance between said at least one brush member and said second brush member increases from respective first ends thereof to respective opposite second ends thereof.

7. A footwear cleaning apparatus as in claim 6 and wherein:

a) said fifth brush member is disposed adjacent said respective opposite second ends of said at least one brush member and said second brush member.

8. A footwear cleaning apparatus as in claim 1 and further including:

a) a drain and plug assembly, said drain and plug assembly operatively associated with said receptacle to permit fluid therein to be removed.

9. A footwear cleaning apparatus as in claim 1 and wherein:

a) said frame assembly is secured to said receptacle side wall with a bolt and cotter pin assembly.

10. A footwear cleaning apparatus comprising:

a) a receptacle for containing a fluid, said receptacle having a side wall, a bottom and an open top;

b) a frame assembly, said frame assembly configured to be received within said receptacle and adapted to be selectively secured to said receptacle side wall;

c) at least one brush member, said at least one brush member having first and second ends, said at least one brush member is fixed to said frame assembly to provide a stationary brushing surface within said receptacle and in a manner so that footwear to be cleaned may be inserted through said open top and be received within said receptacle;

d) said frame assembly including first and second frame members, said first frame member secured to a first end of said at least one brush member and said second frame member secured to a second end of said at least one brush member, each of said first and second frame members secured to said receptacle side wall at opposite ends thereof;

e) a second brush member, said second brush member secured to said frame assembly so that said at least one brush member and said second brush member are parallel and aligned in an opposed relation thereto, each of said at least one brush member and said second brush member disposed adjacent said receptacle open top;

f) third and fourth frame members, each of said third and fourth frame members extending perpendicular to said first and second frame members and therebetween and interconnected to a separate one thereof;

g) first and second frame extension members, each of said first and second frame extension members disposed transverse to said third and fourth frame members and interconnected at one end thereof to a separate one of said third and fourth frame members;

h) third and fourth brush members, one of said third and fourth brush members is secured to an opposite end of said first and second frame extension members and the other of said third and fourth brush members is secured to an opposite end of the other of said first and second frame extension members so that the brush surfaces of said third and fourth brush members are parallel and aligned in an opposed relation thereto; and i) said brush surfaces of said third and fourth brush members are angled upwardly.

11. A footwear cleaning apparatus as in claim 10 and wherein said brush surfaces of said third and fourth brush members disposed relative to each other at an angle of about ninety degrees.

12. A footwear cleaning apparatus comprising:

a) a receptacle for containing a fluid, said receptacle having a side wall, a bottom and an open top;

b) a frame assembly, said frame assembly configured to be received within said receptacle and adapted to be selectively secured to said receptacle side wall;

c) at least one brush member, said at least one brush member having first and second ends, said at least one brush member is fixed to said frame assembly to provide a stationary brushing surface within said receptacle and in a manner so that footwear to be cleaned may be inserted through said open top and be received within said receptacle;

d) said frame assembly including first and second frame members, said first frame member secured to a first end of said at least one brush member and said second frame member secured to a second end of said at least one brush member, each of said first and second frame members secured to said receptacle side wall at opposite ends thereof;

e) a second brush member, said second brush member secured to said frame assembly so that said at least one brush member and said second brush member are parallel and aligned in an opposed relation thereto, each of said at least one brush member and said second brush member disposed adjacent said receptacle open top;

f) third and fourth frame members, each of said third and fourth frame members extending perpendicular to said first and second frame members and therebetween and interconnected to a separate one thereof;

g) first and second frame extension members, each of said first and second frame extension members disposed transverse to said third and fourth frame members and interconnected at one end thereof to a separate one of said third and fourth frame members;

h) third and fourth brush members, one of said third and fourth brush members is secured to an opposite end of said first and second frame extension members and the other of said third and fourth brush members is secured to an opposite end of the other of said first and second frame extension members so that the brush surfaces of said third and fourth brush members are parallel and aligned in an opposed relation thereto;

i) a fifth brush member, said fifth brush member is secured to one of said first and second frame members and aligned transverse thereto; and j) the distance between said at least one brush member and said second brush member increases from respective first ends thereof to respective opposite second ends thereof.

13. A footwear cleaning apparatus comprising:

a) a receptacle for containing a fluid, said receptacle having a side wall, a bottom and an open top;

b) a frame assembly, said frame assembly configured to be received within said receptacle and adapted to be selectively secured to said receptacle side wall;

c) at least one brush member, said at least one brush member having first and second ends, said at least one brush member is fixed to said frame assembly to provide a stationary brushing surface within said receptacle and in a manner so that footwear to be cleaned may be inserted through said open top and be received within said receptacle;

d) said frame assembly including first and second frame members, said first frame member secured to a first end of said at least one brush member and said second frame member secured to a second end of said at least one brush member, each of said first and second frame members secured to said receptacle side wall at opposite ends thereof;

e) a second brush member, said second brush member secured to said frame assembly so that said at least one brush member and said second brush member are parallel and aligned in an opposed relation thereto, each of said at least one brush member and said second brush member disposed adjacent said receptacle open top;

f) third and fourth frame members, each of said third and fourth frame members extending perpendicular to said first and second frame members and therebetween and interconnected to a separate one thereof;

g) first and second frame extension members, each of said first and second frame extension members disposed transverse to said third and fourth frame members and interconnected at one end thereof to a separate one of said third and fourth frame members;

h) third and fourth brush members, one of said third and fourth brush members is secured to an opposite end of said first and second frame extension members and the other of said third and fourth brush members is secured to an opposite end of the other of said first and second frame extension members so that the brush surfaces of said third and fourth brush members are parallel and aligned in an opposed relation thereto; and i) a fifth brush member, said fifth brush member is secured to one of said first and second frame members and aligned transverse thereto and is disposed adjacent said respective opposite second ends of said at least one brush member and said second brush member.

* * * * *